US005990466A

United States Patent [19]

McKee et al.

[11] Patent Number: 5,990,466

[45] Date of Patent: Nov. 23, 1999

[54] APPARATUS FOR SUPPLYING MICROWAVE ENERGY TO A CAVITY

[75] Inventors: Philip R. McKee, Frisco; Earl R. Winkelman, Garland; John David Gidner, Dallas, all of Tex.

[73] Assignee: TurboChef Technologies, Inc., Dallas, Tex.

[21] Appl. No.: 09/053,960

[22] Filed: Apr. 2, 1998

[51] Int. Cl.[6] ..... H05B 6/70

[52] U.S. Cl. ..... 219/746; 219/748; 219/751; 219/697

[58] Field of Search ..... 219/746, 748, 219/749, 751, 745, 717, 756, 695, 697

[56] References Cited

U.S. PATENT DOCUMENTS

| | | | |
|---|---|---|---|
| 2,593,067 | 4/1952 | Spencer . | |
| 2,605,383 | 7/1952 | Spencer . | |
| 2,704,802 | 5/1955 | Blass et al. . | |
| 2,827,537 | 3/1958 | Haagensen | 219/751 |
| 3,104,303 | 9/1963 | Crapuchettes . | |
| 3,104,305 | 9/1963 | Crapuchettes . | |
| 3,527,915 | 9/1970 | Haagensen et al. . | |
| 3,557,334 | 1/1971 | Lewis . | |
| 3,619,536 | 11/1971 | Boehm . | |
| 3,673,370 | 6/1972 | Johnson . | |
| 3,676,809 | 7/1972 | Paine et al. . | |
| 3,715,551 | 2/1973 | Peterson . | |
| 3,789,179 | 1/1974 | Haagensen | 219/751 |
| 3,806,689 | 4/1974 | Kegereis et al. . | |
| 3,810,248 | 5/1974 | Risman et al. . | |
| 3,851,133 | 11/1974 | Dygve et al. . | |
| 4,004,122 | 1/1977 | Hallier | 219/748 |
| 4,019,009 | 4/1977 | Kusunoki et al. . | |
| 4,316,069 | 2/1982 | Fitzmayer | 219/749 |
| 4,336,434 | 6/1982 | Miller . | |
| 4,354,083 | 10/1982 | Staats . | |
| 5,182,426 | 1/1993 | Sklenak et al. | 219/746 |
| 5,254,823 | 10/1993 | McKee et al. . | |
| 5,329,086 | 7/1994 | DeMatteis et al. . | |
| 5,434,390 | 7/1995 | McKee et al. . | |
| 5,449,888 | 9/1995 | Smith et al. . | |
| 5,451,751 | 9/1995 | Takimoto et al. . | |
| 5,558,793 | 9/1996 | McKee et al. . | |
| 5,567,339 | 10/1996 | Joo et al. . | |
| 5,742,033 | 4/1998 | Park . | |

FOREIGN PATENT DOCUMENTS

| | | |
|---|---|---|
| 1407852 | 9/1974 | United Kingdom . |

*Primary Examiner*—Philip H. Leung
*Attorney, Agent, or Firm*—Amster, Rothstein & Ebenstein

[57] ABSTRACT

A microwave oven excitation system comprising a cylindrical microwave launcher for radiating microwave energy into a heating cavity of a microwave oven which is mounted adjacent to the heating cavity in either a substantially vertical position or a substantially horizontal position, a first hollow waveguide secured to the launcher, a first source of microwave energy at a predetermined operating frequency secured to the first waveguide, a second hollow waveguide secured to the launcher substantially perpendicular to the first waveguide, and a second source of microwave energy at a predetermined operating frequency secured to the second waveguide. Alternatively, a single waveguide is secured to the cylindrical launcher and has only a single source of microwave energy secured thereto. In either case, a mode stirrer can be installed within the cylindrical microwave launcher.

26 Claims, 4 Drawing Sheets

APPARATUS FOR SUPPLYING MICROWAVE ENERGY TO A CAVITY

FIELD OF THE INVENTION

The invention relates generally to microwave oven cavity excitation systems, and more particularly to an improved microwave oven cavity excitation system which provides a uniform microwave illumination of the cooking surface and in which cavity loading effects are greatly reduced.

BACKGROUND OF THE INVENTION

It is well known that electromagnetic energy can be utilized for heating foodstuff or other lossy dielectric materials. The foodstuff or other materials are placed in a cooking cavity of a microwave oven and are exposed to electromagnetic energy that is supplied by a suitable source, e.g., a magnetron. After a relatively short period of time during which the foodstuff is subjected to electromagnetic energy, heat will be generated in the foodstuff to accomplish the desired cooking of the foodstuff.

In a microwave oven, an ideal system for exciting the cooking cavity with microwave energy would evenly distribute the microwave energy across those portions of the cavity in which the food is located. Since food is normally located in only a limited area of the oven it is desirable to maximize the energy in the portion of the cavity in which the food is to be located.

Microwave ovens have employed numerous types of feed and distribution systems in an attempt to maximize the energy supplied to the food. For example, in British Patent No. 1,407,852, there is disclosed a microwave oven which utilizes "near field" effects of electromagnetic radiation to heat foods. In this method, the food is maintained in close proximity with a radiation element, a proximity preferably less than one wavelength of the exciting electromagnetic energy. Also, in U.S. Pat. No. 3,810,248, a microwave apparatus is described in which food is placed in a container over slotted openings in a waveguide. The food is heated directly by the microwave energy exiting the waveguide, and indirectly by a radiation absorbing layer in the container that is contact with the food. In addition, U.S. Pat. No. 3,851,133 discloses a microwave oven which includes an antenna chamber, with an antenna in the form of radially extending arms rotating around a common axis mounted therein, disposed adjacent to the cooking cavity with microwave energy being introduced into the cavity through radiation slots disposed on the side of the cavity adjacent the antenna chamber. Also, U.S. Pat. No. 4,019,009 discloses a microwave oven which heats food by subjecting it to a microwave field generated by a surface wave transmission line comprising a slotted wall.

Other known methods for providing a more uniform distribution of microwave energy rely on the use of rotating devices within the cooking cavity, such as a mode stirrer having blades and being driven by a motor cyclically, a rotating food tray, or a rotating antenna. Each of the methods described above has certain drawbacks, particularly if installed in a hybrid oven which combines microwave heating with conventional oven techniques, where the internal temperature of the oven cavity is normally approximately 500 degrees F, such as is more particularly described in U.S. Pat. Nos. 5,254,823, 5,451,751 and 5,558,793.

A particular problem facing many microwave ovens relates to loading effects caused by the size of the foodstuff installed in the cooking cavity. When a small item is placed in the cavity, or especially when the cavity is empty, and the oven is operated, the microwave energy can reflect back to the magnetron, where it is dissipated as heat and can eventually damage the magnetron. A number of methods have been used to prevent such damage to the magnetron. One such method involved placing a thermostat in proximity to the anode of the magnetron to detect the temperature at the magnetron. A control circuit cut off power to the magnetron when the temperature reached a point at which damage would occur. However, in this method the magnetron can still be stressed by relatively high temperatures. Another method, disclosed in U.S. Pat. No. 3,527,915, provides a no-load sensing device that is mounted within the cooking cavity to cut off the magnetron when a specified temperature is reached within the device. In addition, U.S. Pat. No. 5,451,751 discloses a microwave oven which utilizes a wave guide switching device to vary the energy supplied to the cooking cavity depending upon the load installed therein. Each of these methods has certain drawbacks, particularly if installed in the hybrid oven described above.

In U.S. Pat. Nos. 5,254,823, 5,434,590 and 5,558,793. to McKee et al. ("the McKee Patents"), the contents of which are explicitly incorporated by reference herein, a hybrid oven is disclosed for cooking by both hot air impingement and microwave energy. Each oven includes an apparatus, which is shown in FIG. 1 and is generally designated by reference numeral 10, for illuminating a heating cavity with microwave energy. In FIG. 1, first magnetron 11 feeds microwave energy at a preselected frequency into first waveguide 12, and second magnetron 13 feeds microwave energy at the same preselected frequency into second waveguide 14. First waveguide 12 and second waveguide 14 each feed the respective microwave energy into the common third waveguide 15, which mixes the microwave energy and directs it into launcher 16. Launcher 16 is a cylindrical waveguide which directs the mixed microwave energy upward into the heating cavity (not shown) which is disposed directly above launcher 16. A mode stirrer (not shown) may be optionally installed within the launcher 16 to provide a more uniform pattern of illumination in the microwave energy supplied to the heating cavity. In practice, the conventional devices have certain drawbacks. In particular, the loading effects produced were found to be less than optimal.

OBJECTS OF THE INVENTION

It is therefore an object of the present invention to provide an apparatus for transmitting a uniform pattern of microwave energy to a heating cavity.

It is an additional object of the present invention to provide an apparatus for illuminating a cavity with microwave energy which has a reduced dependence on loading within the cavity.

It is yet another object of the present invention to provide an apparatus for illuminating a cavity with microwave energy which extends the operating life of the microwave energy source.

SUMMARY OF THE INVENTION

It has now been found that these and other objects are realized by an apparatus comprising a cylindrical microwave launcher for radiating microwave energy into a heating cavity of a microwave oven which is mounted adjacent to the heating cavity in either a substantially vertical position or a substantially horizontal position. A first hollow waveguide is secured to the launcher, and a first source of microwave energy at a predetermined operating frequency is secured to the first waveguide. A second hollow waveguide is secured to the launcher substantially perpendicular to the first waveguide, and a second source of microwave energy at a predetermined operating frequency is secured to the second waveguide.

In another preferred embodiment, a single waveguide is secured to the cylindrical launcher and has a single source of microwave energy secured thereto.

In either embodiment, a mode stirrer can be installed within the cylindrical microwave launcher to more uniformly distribute the microwave energy supplied to the heating cavity.

BRIEF DESCRIPTION OF THE DRAWINGS

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
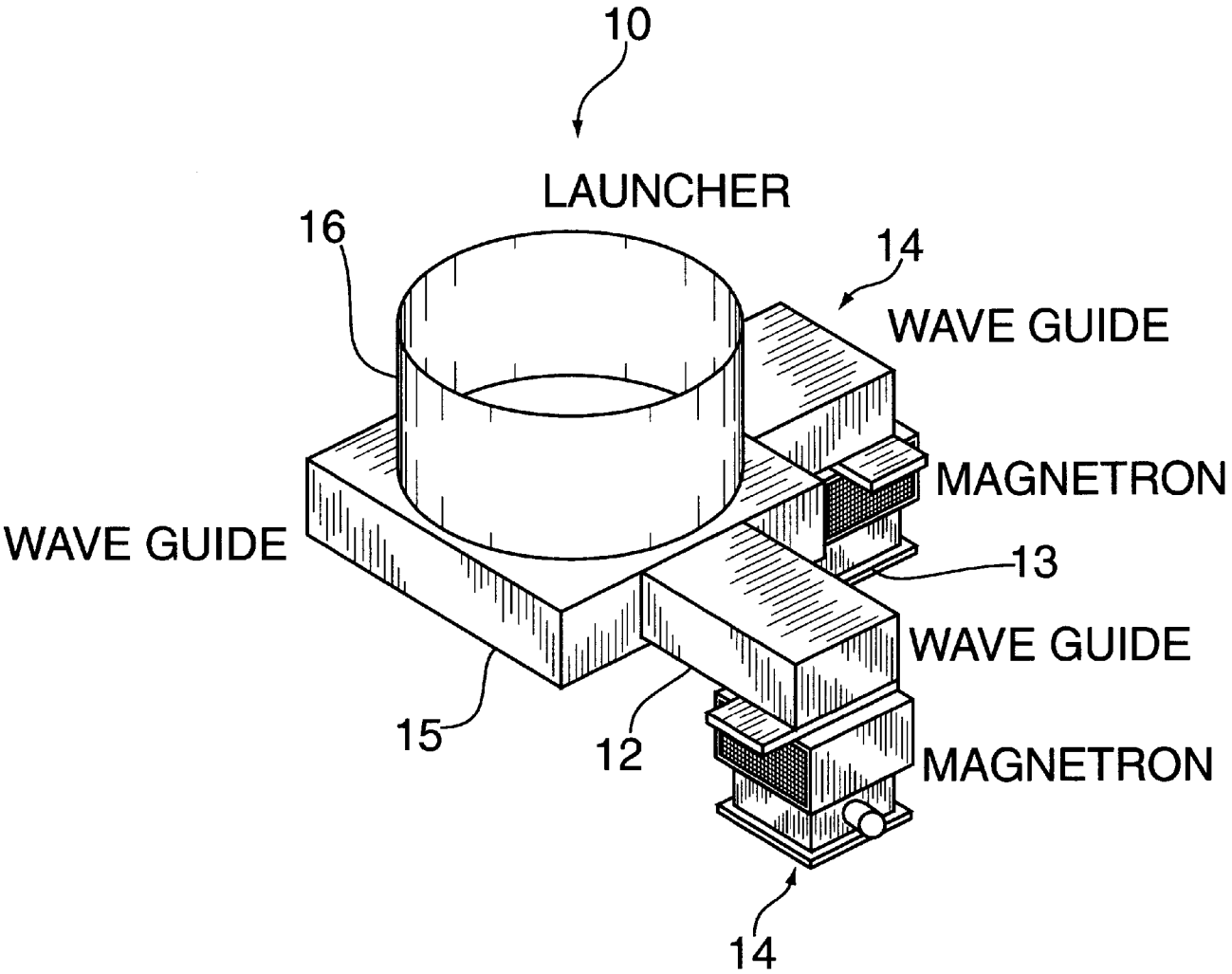
FIG. 1 PRIOR ART
FIG. 1 is an isometric view of a prior art apparatus for providing microwave energy to a heating cavity.

The present invention is an improvement to the microwave oven cavity excitation system generally disclosed in the McKee Patents (see FIG. 1), although, as one reasonably skilled in the art will recognize, the present invention can be applied to any system which implements heating by microwave energy.

Figure 2:
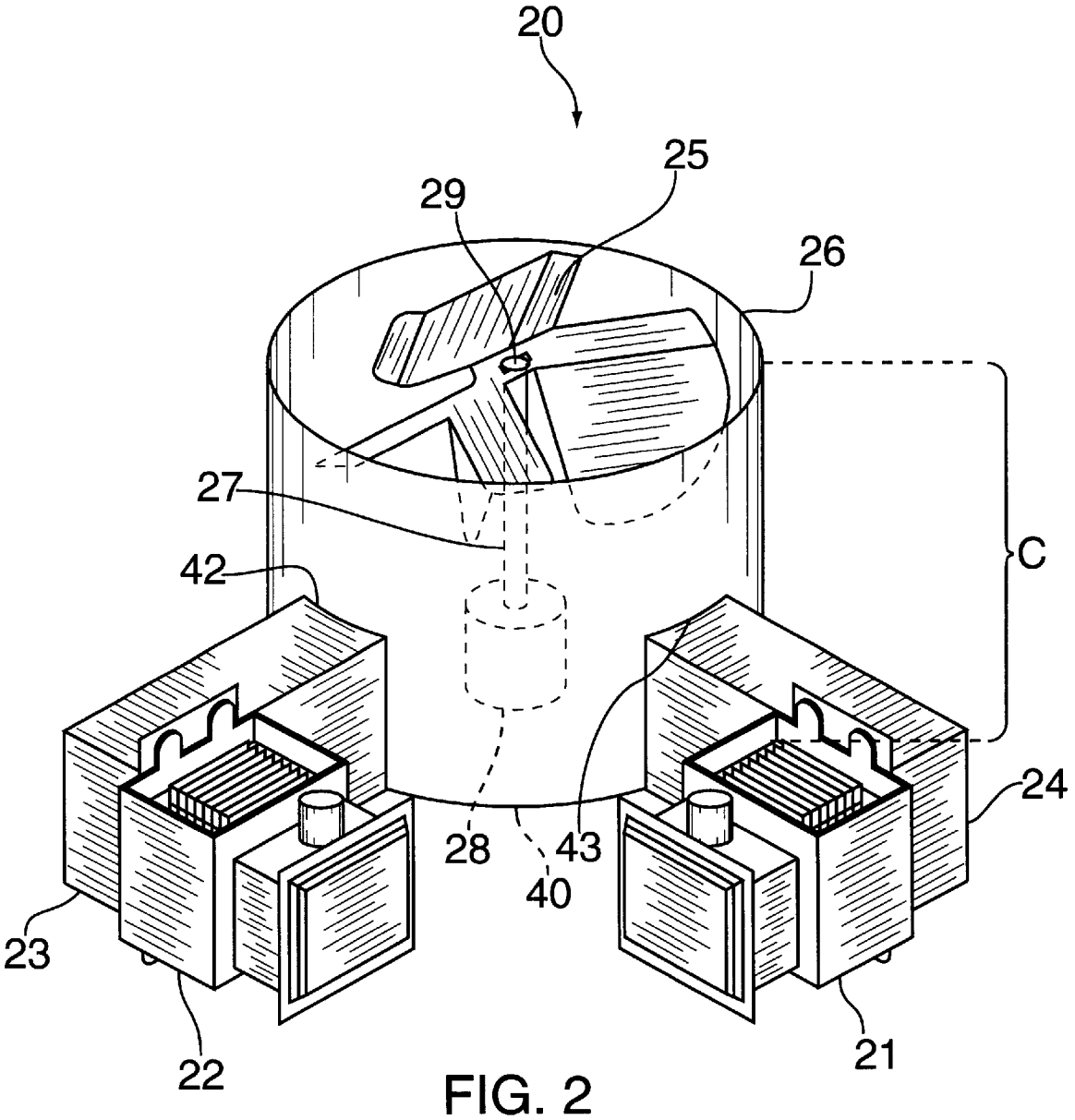
FIG. 2 is an isometric assembly view of a first embodiment of the present invention.
Figure 3:
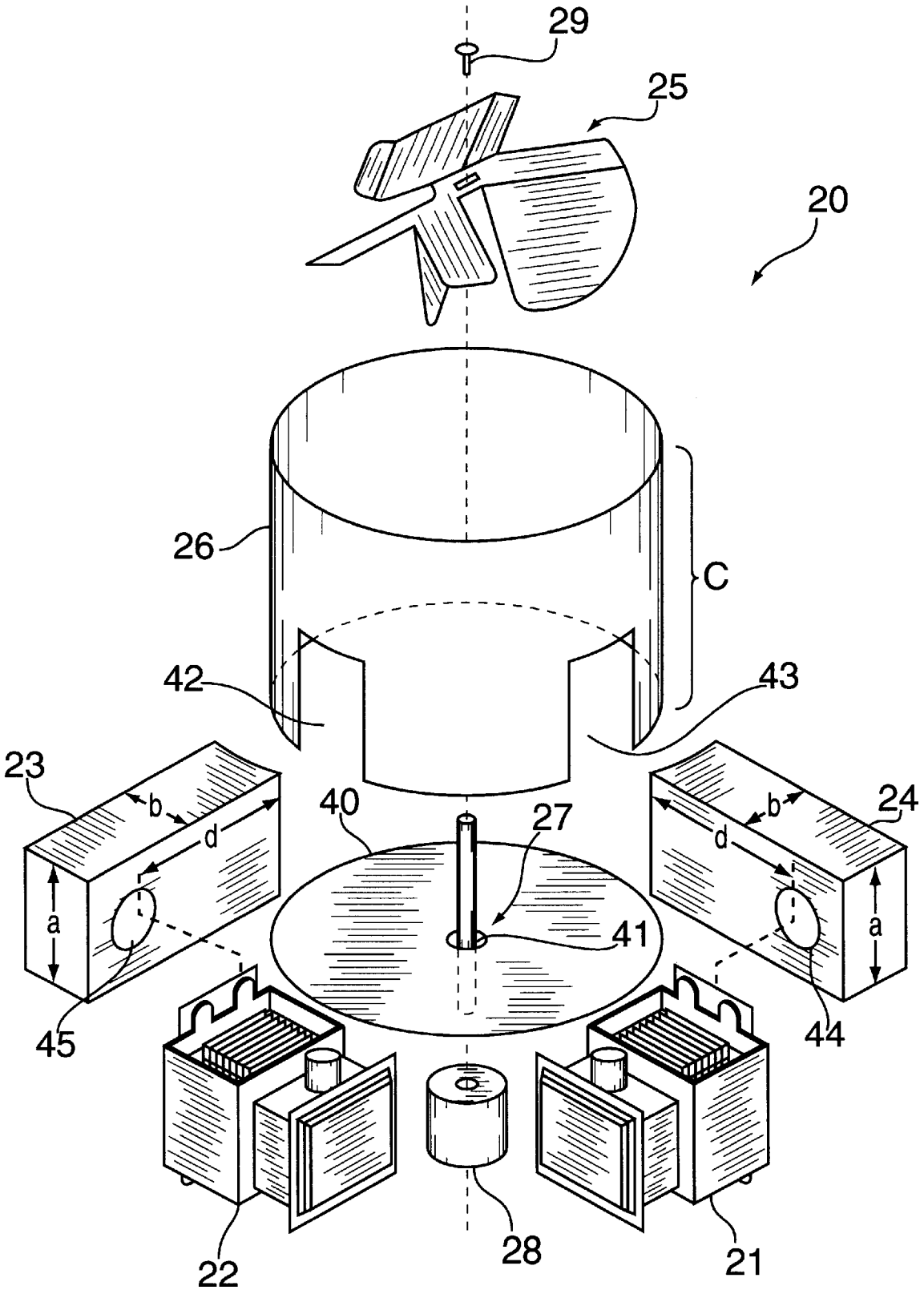
FIG. 3 is a isometric exploded view thereof.

Referring now to the drawing, and in particular FIGS. 2–3, wherein illustrated is a first embodiment of the present invention which is generally designated by the reference numeral 20 and comprises a first waveguide 24 and a second waveguide 23, each waveguide 23 and 24 having an end mounted to launcher 26 at apertures 42 and 43, respectively. Launcher 26 is a cylindrical waveguide which is mounted substantially vertically and which directs microwave energy transmitted from the waveguides 24 and 23 upwards to a heating cavity (not shown) disposed vertically above and centrally aligned with launcher 26. As one reasonably skilled in the art will realize, launcher 26 may also be mounted above the heating cavity, wherein said heating cavity will be disposed vertically below and centrally aligned with launcher 26. Likewise, launcher 26 may be mounted horizontally, wherein said heating cavity will be disposed horizontally alongside and centrally aligned with launcher 26, as is the case when FIG. 2 is rotated ninety degrees.

Launcher 26 has a top end (not shown) which is transparent to microwave energy and a bottom end 40 which blocks the transmission of microwave energy therethrough. Magnetron 21 is mounted to a sidewall of waveguide 24 at an opposite end remote from the end securing the waveguide 24 to launcher 26. Similarly, magnetron 22 is mounted to a sidewall of waveguide 23 at an opposite end remote from the end securing the waveguide 23 to launcher 26. As is commonly known in the art, magnetrons emit microwave energy at a predetermined frequency. In the preferred mode of the present invention, each magnetron 21 and 22 emits microwave energy at a nominal frequency of 2450 MHZ into waveguides 24 and 23 through apertures 43 and 42, respectively.

Preferably, a motor 28 is mounted below the bottom end 40 of launcher 26, with a mode stirrer 25 mounted to a grounded shaft 27 with a fastener 29, and grounded shaft 27 in turn is mounted to motor 28 through aperture 41 in bottom end 40 of launcher 26. During operation, the motor 28 causes mode stirrer 25 to rotate to further ensure that a uniform pattern of microwave energy is provided to the heating cavity.

Launcher 26 is preferably formed in length c in multiples of one-half the free space wavelength of the microwave energy emitted by the magnetrons. For example, at a frequency f of 2450 MHZ, because $\lambda=(3\times10^8\ (\text{m/s}))/(f\ (\text{Hz}))$, the free space wavelength, λ, is equal to 12.25 cm (4.82 inches). Thus, the length of launcher c is preferably equal to n/2×4.82 inches, where n is an integer greater than zero. The diameter of launcher 26 is preferably at least twice the wavelength, i.e., at least 2×4.82 inches for a nominal frequency of 2450 MHZ. The walls of launcher 26 are aligned in a substantially vertical direction below the heating cavity (not shown) in this embodiment.

Waveguides 23 and 24 are preferably of rectangular cross-section, with the sidewalls having a vertical dimension a which is larger than the horizontal dimension b of the top and bottom walls, although as one reasonably skilled in the art will recognize, waveguides 23 and 24 may be of square cross-section, wherein the vertical dimension a is equal to the horizontal dimension b, or waveguides 23 and 24 may be of rectangular cross section with the vertical dimension a less than the horizontal dimension b. For each waveguide 23 and 24, the sidewalls are aligned substantially vertically with the walls of launcher 26. The actual dimensions a and b for waveguides 23 and 24 can be determined from the following equations, wherein λ is the free space wavelength (which is known based upon the magnetron output frequency), $\lambda_g$ is the wavelength in the waveguide, and $Z_g$ is the impedance of the waveguide:

$$\lambda_g = \frac{\lambda}{\sqrt{1-\left(\frac{\lambda}{2a}\right)^2-\left(\frac{\lambda}{2b}\right)^2}} \tag{1}$$

$$Z_g = (592)\left(\frac{b}{a}\right)\left(\frac{\lambda_g}{\lambda}\right) \tag{2}$$

There will be a range of values possible for a and b. To determine the values for a and b, a desired impedance $Z_g$ is chosen, preferably in the range of 400–600 ohms, then simultaneous solution of equations are used to solve the two equations for selected values of a orb. Preferably, the apertures 44 and 45 to which magnetrons 21 and 22 are secured are centrally aligned verticall y to the waveguides 24 and 23, respectively, and are positioned a distance d away from the open end of the respective waveguides 24 and 23, where d is calculated in integral multiples of one-quarter of the wavelength atlg Indeed, in some special applications it may even be desirable to make waveguides 23 and 24 circular in cross-section.

The launcher 26 and waveguides 23 and 24 are of conventional construction, preferably formed from 304 stainless steel.

When the magnetrons 21 and 22 are mounted to waveguides 23 and 24 as shown in FIGS. 2 and 3, magnetrons 21 and 22 emit microwave energy horizontally, perpendicular to the axis by which microwave energy is transmitted from the launcher 26 to the heating cavity. This is in contrast with the microwave cavity excitationo system of the McKee Patents shown in FIG. 1, wherein the magnetrons 10 and 11 emit microwave energy vertically, parallel to the axis by which microwave energy is transmitted from the launcher 15 to the heating cavity. In addition, the microwave cavity excitation system of the McKee Patents shown in FIG. 1 includes an additional waveguide 15 which is not required in the present invention. By eliminating the additional waveguide 15 and rotating the waveguides 23 and 24 and the magnetrons 22 and 21 ninety degrees, the apparatus of the present invention provides a microwave energy signal to the heating cavity with a much lower Q, measured broad band, and thus can hold the same voltage standing wave ratio (VSWR) over a wide range of internal loads. While providing this low Q signal, the present invention can also provide a very uniform illumination pattern in the microwave energy supplied to the heating cavity.

Figure 4:
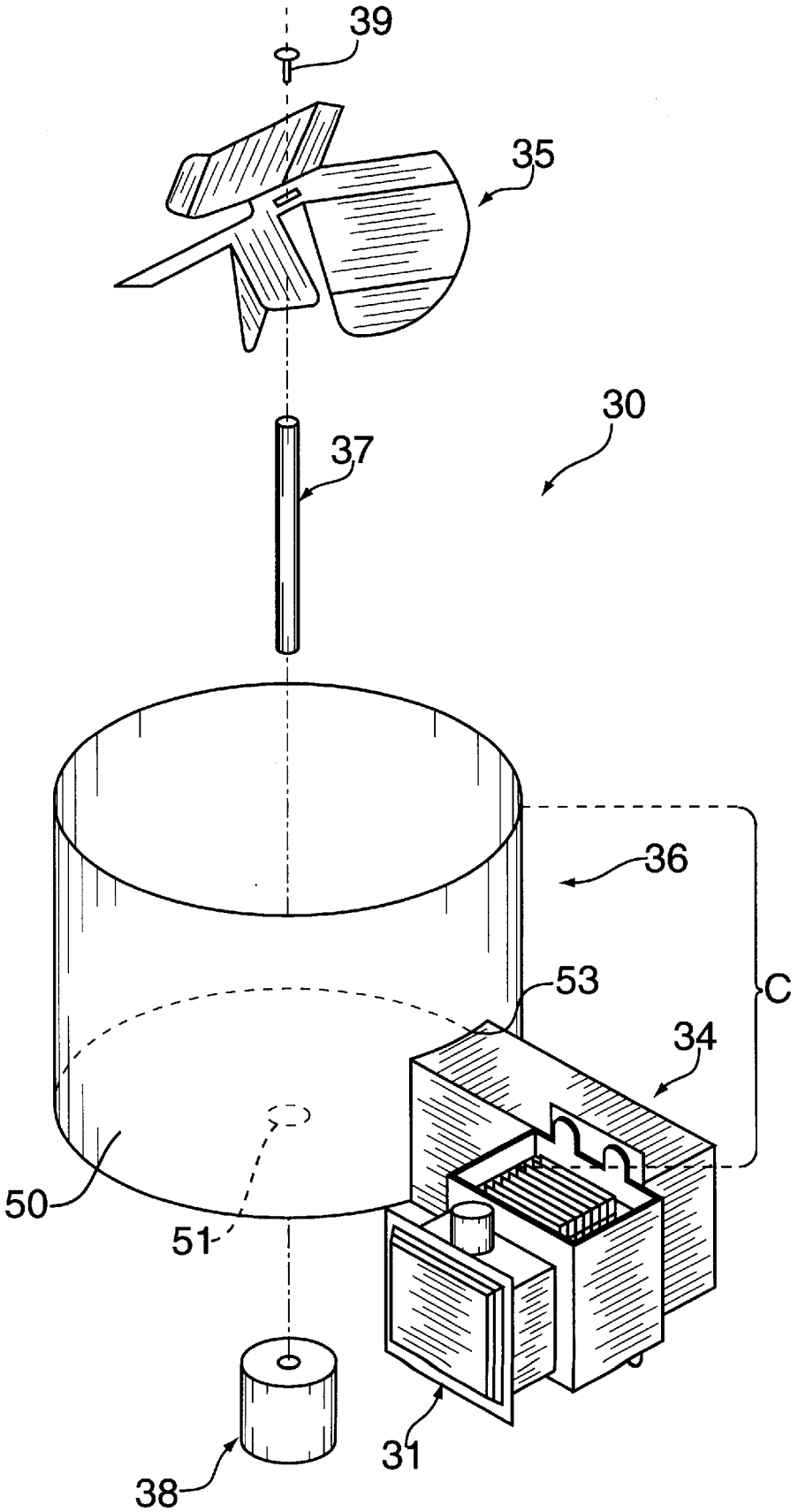
FIG. 4 is an isometric view of a second embodiment of the present invention.

Referring now to FIG. 4, therein illustrated is the second embodiment of the present invention, generally designated by reference numeral 30, wherein a single waveguide 34 is mounted to launcher 36 at an aperture 53. In the same manner as the first embodiment of the present invention, launcher 36 is a cylindrical waveguide which directs microwave energy transmitted from the waveguide 34 upwards to a heating cavity (not shown) disposed vertically above and centrally aligned with launcher 36. Launcher 36 has a top end (not shown) which is transparent to microwave energy and a bottom end 50 which blocks the transmission of microwave energy therethrough. Magnetron 31 is mounted to a sidewall of waveguide 34 at an end remote from the end at which the waveguide 34 is secured to launcher 36. In the preferred mode of this aspect of the present invention, magnetron 31 emits microwave energy at a nominal frequency of 2450 MHZ. As one reasonably skilled in the art will realize, like the first embodiment the launcher 36 may be also mounted above or alongside the heating cavity.

As in the first embodiment of the present invention, preferably a motor 38 is mounted below launcher 36 in the embodiment depicted in FIG. 4, with a mode stirrer 35 mounted to a grounded shaft 37 with a fastener 39, and grounded shaft 37 is in turn mounted to motor 38 through aperture 51 of bottom end 50 of launcher 36, to further ensure that a uniform pattern of microwave energy is provided to the heating cavity.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. An apparatus for supplying microwave energy to a heating cavity, comprising:

(A) a cylindrical microwave launcher for radiating microwave energy into a heating cavity disposed on a horizontal plane, said launcher having a first end which blocks the transmission of microwave energy, a second end which is transparent to microwave energy, and a sidewall forming a cylinder connecting said first end and said second end of said launcher, said launcher having a longitudinal axis and being mountable adjacent to the heating cavity such that said longitudinal axis of said launcher forms with said horizontal plane an angle which is an integral multiple of ninety degrees;

(B) a first waveguide having an open end secured to said sidewall of said launcher for microwave communication therewith through an aperture in said sidewall of said launcher and a closed end opposite said open end to preclude microwave escape therethrough; and (C) a first source of microwave energy at a predetermined operating frequency secured to said first waveguide adjacent to said closed end for microwave communication therewith.

2. The apparatus of claim 1, further comprising:

(D) a second waveguide having an open end secured to said sidewall of said launcher for microwave communication therewith through an aperture in said sidewall of said launcher and a closed end opposite said open end to preclude microwave escape therethrough; and (E) a second source of microwave energy at a predetermined operating frequency secured to said second waveguide adjacent to said closed end of said second waveguide for microwave communication therewith.

3. The apparatus of claim 2, wherein said predetermined operating frequency of said first source of microwave energy is equal to said predetermined operating frequency of said second source of microwave energy.

4. The apparatus of claim 2, wherein said second waveguide is secured to said launcher at an angle perpendicular to said first waveguide.

5. The apparatus of claim 1, wherein said launcher has a diameter of at least two times the free space wavelength of the microwave energy and said launcher has a height which is a multiple of one-half the free space wavelength of the microwave energy.

6. The apparatus of claim 1, wherein a rotating mode stirrer is mounted within said launcher.

7. The apparatus of claim 1, wherein said longitudinal axis of said launcher is perpendicular to said horizontal plane of said heating cavity and said first hollow waveguide is of rectangular cross-section and includes vertically spaced apart top and bottom walls connecting said open end and said closed end, and horizontally spaced apart sidewalls connecting said open end and said closed end, said sidewalls being spaced apart less than said top and bottom walls, one of said sidewalls having an opening adjacent to said closed end, said first waveguide being secured to said launcher such that said sidewalls are substantially vertical.

8. The apparatus of claim 7, further comprising:

(D) a second hollow waveguide of rectangular cross-section having an open end secured to said launcher for microwave communication therewith, a closed end opposite said open end to preclude microwave escape therethrough, vertically spaced apart top and bottom walls connecting said open end and said closed end, and horizontally spaced apart sidewalls connecting said open end and said closed end, said sidewalls being spaced apart less than said top and bottom walls, one of said sidewalls having an opening adjacent to said closed end, said second waveguide being secured to said launcher such that said sidewalls are substantially vertical, said second waveguide being secured to said launcher substantially perpendicular to said first waveguide; and (E) a second source of microwave energy at a predetermined operating frequency secured to said opening in one of said sidewalls of said second waveguide for microwave communication therewith.

9. The apparatus of claim 7, wherein said top and bottom walls of said first hollow waveguide each has an interior surface and an exterior surface, and wherein said horizontally spaced apart sidewalls of said first hollow waveguide each has an interior surface and an exterior surface, such that said interior surfaces of each of said sidewalls are spaced apart less than said interior surfaces of said top wall and said bottom wall.

10. The apparatus of claim 9, further comprising:

(D) a second hollow waveguide of rectangular cross-section having an open end secured to said launcher for microwave communication therewith, a closed end opposite said open end to preclude microwave escape therethrough, vertically spaced apart top and bottom walls connecting said open end and said closed end, said top and bottom walls each having an interior surface and an exterior surface, and horizontally spaced apart sidewalls connecting said open end and said closed end, each of said sidewalls having an interior surface and an exterior surface, said interior surfaces of each of said sidewalls being spaced apart less than said interior walls of said top wall and said bottom wall, one of said sidewalls having an opening adjacent to said closed end, said second waveguide being secured to said launcher such that said sidewalls are substantially vertical, said second waveguide secured to said launcher substantially perpendicular to said first waveguide; and (E) a second source of microwave energy at a predetermined operating frequency secured to said opening in one of said sidewalls of said second waveguide for microwave communication therewith.

11. The apparatus of claim 9, wherein said first source of microwave energy has a longitudinal axis substantially perpendicular to the longitudinal axis of said first waveguide.

12. The apparatus of claim 11, further comprising:

(D) a second hollow waveguide of rectangular cross-section having an open end secured to said launcher for microwave communication therewith, a closed end opposite said open end to preclude microwave escape therethrough, vertically spaced apart top and bottom walls connecting said open end and said closed end, and horizontally spaced apart sidewalls connecting said open end and said closed end, said sidewalls being spaced apart less than said top and bottom walls, one of said sidewalls having an opening adjacent to said closed end, said second waveguide being secured to said launcher such that said sidewalls are substantially vertical, said second waveguide being secured to said launcher substantially perpendicular to said first waveguide; and (E) a second source of microwave energy at a predetermined operating frequency secured to said opening in one of said sidewalls of said second waveguide, said second source of microwave energy having a longitudinal axis substantially perpendicular to the longitudinal axis of said second waveguide.

13. The apparatus of claim 1, wherein said longitudinal axis of said launcher is parallel to said horizontal plane of said heating cavity and said first hollow waveguide is of rectangular cross-section and includes horizontally spaced apart top and bottom walls connecting said open end and said closed end, and vertically spaced apart sidewalls connecting said open end and said closed end, said sidewalls being spaced apart less than said top and bottom walls, one of said sidewalls having an opening adjacent to said closed end, said first waveguide being secured to said launcher such that said sidewalls are substantially horizontal.

14. The apparatus of claim 13, further comprising:

(D) a second hollow waveguide of rectangular cross-section having an open end secured to said launcher for microwave communication therewith, a closed end opposite said open end to preclude microwave escape therethrough, horizontally spaced apart top and bottom walls connecting said open end and said closed end, and vertically spaced apart sidewalls connecting said open end and said closed end, said sidewalls being spaced apart less than said top and bottom walls, one of said sidewalls having an opening adjacent to said closed end, said second waveguide being secured to said launcher such that said sidewalls are substantially horizontal, said second waveguide being secured to said launcher substantially perpendicular to said first waveguide; and (E) a second source of microwave energy at a predetermined operating frequency secured to said opening in one of said sidewalls of said second waveguide for microwave communication therewith.

15. The apparatus of claim 13, wherein said top and bottom walls of said first hollow waveguide each has an interior surface and an exterior surface, and wherein said vertically spaced apart sidewalls of said first hollow waveguide each has an interior surface and an exterior surface, such that said interior surfaces of each of said sidewalls are spaced apart less than said interior surfaces of said top wall and said bottom wall.

16. The apparatus of claim 15, further comprising:

(D) a second hollow waveguide of rectangular cross-section having an open end secured to said launcher for microwave communication therewith, a closed end opposite said open end to preclude microwave escape therethrough, horizontally spaced apart top and bottom walls connecting said open end and said closed end, said top and bottom walls each having an interior surface and an exterior surface, and vertically spaced apart sidewalls connecting said open end and said closed end, each of said sidewalls having an interior surface and an exterior surface, said interior surfaces of each of said sidewalls being spaced apart less than said interior walls of said top wall and said bottom wall, one of said sidewalls having an opening adjacent to said closed end, said second waveguide being secured to said launcher such that said sidewalls are substantially horizontal, said second waveguide secured to said launcher substantially perpendicular to said first waveguide; and (E) a second source of microwave energy at a predetermined operating frequency secured to said opening in one of said sidewalls of said second waveguide for microwave communication therewith.

17. The apparatus of claim 15, wherein said first source of microwave energy has a longitudinal axis substantially perpendicular to the longitudinal axis of said first waveguide.

18. The apparatus of claim 17, further comprising:

(D) a second hollow waveguide of rectangular cross-section having an open end secured to said launcher for microwave communication therewith, a closed end opposite said open end to preclude microwave escape therethrough, horizontally spaced apart top and bottom walls connecting said open end and said closed end, and vertically spaced apart sidewalls connecting said open end and said closed end, said sidewalls being spaced apart less than said top and bottom walls, one of said sidewalls having an opening adjacent to said closed end, said second waveguide being secured to said launcher such that said sidewalls are substantially horizontal, said second waveguide being secured to said launcher substantially perpendicular to said first waveguide; and (E) a second source of microwave energy at a predetermined operating frequency secured to said opening in one of said sidewalls of said second waveguide, said second source of microwave energy having a longitudinal axis substantially perpendicular to the longitudinal axis of said second waveguide.

19. In a hybrid oven for cooking an article in a cooking chamber by both hot air impingement and microwave energy, an improved apparatus for supplying microwave energy to the cooking chamber, comprising:

(A) a cylindrical microwave launcher for radiating microwave energy into the cooking chamber, said launcher having a first end which blocks the transmission of microwave energy, a second end which is transparent to microwave energy and a sidewall forming a cylinder connecting said first end and said second end of said launcher, said launcher being mounted adjacent to the cooking chamber such that a longitudinal axis of said launcher is substantially vertical;

(B) a first hollow rectangular waveguide having an open end secured to said sidewall of said launcher for microwave communication therewith through an aperture in said sidewall of said launcher, a closed end opposite said open end, vertically spaced apart top and bottom walls connecting said open end and said closed end, and horizontally spaced apart sidewalls connecting said open end and said closed end, said sidewalls being spaced apart less than said top and bottom walls, one of said sidewalls having an opening adjacent to said closed end, said first waveguide being secured to said launcher such that said sidewalls are substantially vertical;

(C) a first source of microwave energy at a predetermined operating frequency secured to said opening in said one sidewall of said first waveguide;

(D) a second hollow rectangular waveguide having an open end secured to said sidewall of said launcher for microwave communication therewith through an aperture in said sidewall of said launcher, a closed end opposite said open of said waveguide, vertically spaced apart top and bottom walls connecting said open end and said closed end of said second waveguide, and horizontally spaced apart sidewalls connecting said open end and said closed end of said second waveguide, said sidewalls of said second waveguide being spaced apart less than said top and bottom walls of said second waveguide, one of said sidewalls of said second waveguide having an opening adjacent to said closed end of said second waveguide, said second waveguide being secured to said launcher such that said sidewalls of said second waveguide are substantially vertical, said second waveguide secured to said launcher being substantially perpendicular to said first waveguide; and (E) a second source of microwave energy at said predetermined operating frequency secured to said opening in said one sidewall of said second waveguide.

20. The apparatus of claim 19, wherein a rotating mode stirrer is mounted within said cylindrical microwave launcher.

21. The apparatus of claim 19, wherein said launcher has a diameter of at least two times the free space wavelength of the microwave energy and said launcher has a height which is a multiple of one-half the free space wavelength of the microwave energy.

22. The apparatus of claim 19, wherein said predetermined operating frequency of said first source of microwave energy is equal to said predetermined operating frequency of said second source of microwave energy.

23. In a hybrid oven for cooking an article in a cooking chamber by both hot air impingement and microwave energy, an improved apparatus for supplying microwave energy to the cooking chamber, comprising:

(A) a cylindrical microwave launcher for radiating microwave energy into the cooking chamber, said launcher having a first end which blocks the transmission of microwave energy, a second end which is transparent to microwave energy, and a sidewall forming a cylinder connecting said first end and said second end of said launcher, said launcher being mounted adjacent to the cooking chamber such that a longitudinal axis of said launcher is substantially horizontal;

(B) a first hollow rectangular waveguide having an open end secured to said sidewall of said launcher for microwave communication therewith through an aperture in said sidewall of said launcher, a closed end opposite said open end, horizontally spaced apart top and bottom walls connecting said open end and said closed end, and vertically spaced apart sidewalls connecting said open end and said closed end, said sidewalls being spaced apart less than said top and bottom walls, one of said sidewalls having an opening adjacent to said closed end, said first waveguide being secured to said launcher such that said sidewalls are substantially horizontal;

(C) a first source of microwave energy at a predetermined operating frequency secured to said opening in said one sidewall of said first waveguide;

(D) a second hollow rectangular waveguide having an open end secured to said sidewall of said launcher for microwave communication therewith through an aperture in said sidewall of said launcher, a closed end opposite said open end of said second waveguide, horizontally spaced apart top and bottom walls connecting said open end and said closed end of said second waveguide, and vertically spaced apart sidewalls connecting said open end and said closed end of said second waveguide, said sidewalls of said second waveguide being spaced apart less than said top and bottom walls of said second waveguide, one of said sidewalls of said second waveguide having an opening adjacent to said closed end of said second waveguide, said second waveguide being secured to said launcher such that said sidewalls of said second waveguide are substantially horizontal, said second waveguide secured to said launcher being substantially perpendicular to said first waveguide; and (E) a second source of microwave energy at said predetermined operating frequency secured to said opening in said one sidewall of said second waveguide.

24. The apparatus of claim 23, wherein a rotating mode stirrer is mounted within said cylindrical microwave launcher.

25. The apparatus of claim 23, wherein said launcher has a diameter of at least two times the free space wavelength of the microwave energy and said launcher has a height which is a multiple of one-half the free space wavelength of the microwave energy.

26. The apparatus of claim 23, wherein said predetermined operating frequency of said first source of microwave energy is equal to said predetermined operating frequency of said second source of microwave energy.

* * * * *